US008443732B2

(12) United States Patent
Sullivan

(10) Patent No.: US 8,443,732 B2
(45) Date of Patent: May 21, 2013

(54) HIGH ANGLE OF ATTACK MULTI SPECTRAL MARKING PROJECTILE/BOMB

(75) Inventor: Kevin Michael Sullivan, Kennebunk, ME (US)

(73) Assignee: Rheinmetall Waffe Munition GmbH, Unterleuss (DE)

( * ) Notice: Subject to any disclaimer, the term of this patent is extended or adjusted under 35 U.S.C. 154(b) by 237 days.

(21) Appl. No.: 12/821,238

(22) Filed: Jun. 23, 2010

(65) Prior Publication Data

US 2012/0204749 A1 Aug. 16, 2012

Related U.S. Application Data

(60) Provisional application No. 61/269,615, filed on Jun. 26, 2009.

(51) Int. Cl.
*F42B 8/12* (2006.01)

(52) U.S. Cl.
USPC ..... 102/513

(58) Field of Classification Search
USPC ..... 102/513, 370, 502, 395, 334, 498, 102/382, 445, 368; 89/1.11
See application file for complete search history.

(56) References Cited

U.S. PATENT DOCUMENTS

| | | | | |
|---|---|---|---|---|
| 2,084,366 | A | 6/1937 | Goss | |
| 3,811,381 | A * | 5/1974 | Fichter et al. | 102/513 |
| 3,983,817 | A * | 10/1976 | Tucker | 102/513 |
| 4,505,200 | A | 3/1985 | Bush | |
| 5,661,257 | A * | 8/1997 | Nielson et al. | 102/334 |
| 6,269,747 | B1 * | 8/2001 | Strandli et al. | 102/334 |
| 6,497,181 | B1 | 12/2002 | Manole et al. | |
| 6,619,211 | B1 | 9/2003 | Haeselich | |
| 6,871,594 | B1 | 3/2005 | Estrella | |
| 6,990,905 | B1 * | 1/2006 | Manole et al. | 102/513 |
| 7,055,438 | B1 * | 6/2006 | Manole et al. | 102/513 |
| RE40,482 | E | 9/2008 | Haeselich | |
| 2006/0032393 | A1 | 2/2006 | Haeselich | |
| 2008/0053330 | A1 | 3/2008 | Haeselich | |

* cited by examiner

*Primary Examiner* — Stephen M Johnson
*Assistant Examiner* — John D Cooper
(74) *Attorney, Agent, or Firm* — Karl F. Milde, Jr.; Eckert Seamans Cherin & Mellott, LLC

(57) ABSTRACT

A high angle-of-attack projectile or bomb comprises separate compartments that, after launch allow for (a) mixing of the chemi-luminescent materials, (b) heating of the materials in the projectile vessel, (c) pressurization of the projectile vessel, and (d) efficient expulsion of a day marker and heated chemi-luminescent mix upon striking the target. The projectile/bomb allows for the marking of targets. The projectile/bomb does not create unexploded ordnance (UXO) and minimizes use of energetic materials such as reactive chemicals and/or pyrotechnics.

10 Claims, 16 Drawing Sheets

Tubular 5-Compartment Design

5 Compartment Tubular Vessel with membranes or seals separating compartments.

Compartments in tubular vessel are separated by membranes or seals and have:

"A" day marking material loaded into a discarding carrier that is ejected
"B and C" chemi-luminescent mix
"D" and "E" gas pressure mix Vent Projectile includes:

- 5 Compartment tubular vessel fitted into mortar body
- Ogive including a piston
- Venting Configuration on tail of Mortar Tubular 5 Compartment Design Seals / Membranes B-C and D-E break on "set-back" allowing materials in compartment to mix When compartments B+C mixes the chemicals form a chemi-luminescent mix When compartment's D+E mixes the reaction produce a gas-liquid under pressure Compartment D-E pressurized in flight Mortar Trajectory Set Back

HIGH ANGLE OF ATTACK MULTI SPECTRAL MARKING PROJECTILE/BOMB

CROSS-REFERENCE TO RELATED APPLICATION

This application claims priority from Provisional Patent Application No. 61/269,615, filed Jun. 26, 2009.

BACKGROUND OF THE INVENTION

The present invention relates to the field of practice ammunition and practice bombs and, specifically, to a projectile/bomb that marks the point of impact both by day and by night.

More particularly, the invention concerns a device that provides for marking on high angle-of-attack projectiles and bombs. High angle-of-attack projectiles/bombs include mortar ammunition, artillery ammunition and gravity bombs launched from aircraft.

As used hereinafter, the term "projectile" is intended to include both ground-launched projectiles and aircraft-launched bombs.

Impact marking projectiles are well known in the art. Marking projectiles which use a dry powder, such as a red powder dye, for marking the impact by day are known, for example, from the U.S. Patent Publication No. 2006/0032393 to Haeselich. Marking projectiles which use chemi-luminescent materials for marking their impact by night are also known. Reference is made, for example, to the U.S. Pat. No. 6,619,211 and the aforementioned Patent Publication, both to Haeselich, which disclose such practice ammunition. U.S. Pat. Nos. 6,497,181 and 6,990,905 to Manole et al. also disclose similar devices.

These types of devices have several drawbacks:

First, if the projectile impacts soft ground, it may not burst open, and thus may not mark the point of impact. This situation often occurs with high angle-of-attack projectiles which are intended to contact the ground, rather than a building structure.

Also, due to its high velocity, the projectile might bury itself in the ground, preventing the marking material from being properly dispersed.

Further, if the projectile is launched in cold weather, the chemi-luminescent materials require extra time to reach full luminance when mixed on setback or when dropped from an aircraft. Upon impact, the materials may not have had time to reach their full luminescent output.

SUMMARY OF THE INVENTION

It is therefore a principal object of the present invention to provide a projectile which remains operable to mark a point of impact, both by day and by night, even in the case of an impact with soft soil.

It is further principal object of the invention to provide a projectile which is operable to mark a point of impact, both by day and by night, in any type of weather.

These objects, as well as further objects which will become apparent from the discussion that follows, are achieved, in accordance with the present invention, by providing a projectile that comprises:

(a) a projectile body, designed to withstand the forces applied when the projectile is launched, having (1) a projectile head with an ogive designed to impact the target and (2) a projectile tail designed to steady the projectile in flight, the projectile body having a central longitudinal axis between the head and the tail;

(b) a plurality of compartments disposed within the projectile body and arranged successively along the longitudinal axis between the projectile head and projectile tail, the compartments being separated by compartment walls, at least one of which is designed to be broken when the projectile is launched; and (c) at least one marking agent disposed in at least one of the compartments for marking the position of the target when the projectile strikes the target, the marking agent comprising one or more of the following materials:

(1) a plurality of first chemical components each received in a separate one of the compartments, the first components being mixed and reacting chemically with each other during flight of the projectile, causing the mixed first components to luminesce and mark the target when the projectile strikes the target, the wall between the compartments holding the first components being designed to be broken when the projectile is launched, while retaining the first chemical components within the projectile body, so that the first components are mixed at the time the projectile is launched and luminesce by the time the projectile strikes the target; and/or (2) a plurality of second chemical components each received in a separate one of the compartments, the second components being mixed and reacting chemically with each other during the flight of the projectile, causing the second components to create heat, the wall between the compartments holding the second components being designed to be broken when the projectile is launched, while retaining the second components within the projectile body, so that the second components are mixed at the time the projectile is launched and create heat by the time the projectile strikes the target; and/or (3) a plurality of third chemical components each received in a separate one of the compartments, the third components being mixed and reacting chemically with each other during the flight of the projectile, causing the third components to create pressure within the projectile vessel, the wall between the compartments holding the third components being designed to be broken when the projectile is launched, while retaining the third chemical components within the projectile body, so that the third components are mixed at the time the projectile is launched and create pressure within the projectile vessel by the time the projectile strikes the target; and/or (4) a low density, fine, dry powder material disposed in a separate one of the compartments and designed to create a plume for marking the target when the projectile strikes the target.

The second and third chemical components may be one in the same, creating both heat and pressure upon reaction when mixed.

Advantageously, the projectile further comprises a piston disposed in the projectile head and arranged to press against the compartments, by a force applied by the ogive when said projectile strikes the target, the piston forcing the compartments to discharge at least one marking agent out an opening in the projectile tail. The compression of the piston further pressurizes and further heats the mixed materials on impact.

The walls between compartments may be broken on setback, either by the force of acceleration and/or the centrifugal force due to spinning of the projectile, or they may be broken upon launch from an aircraft due to one or both of the wind and air pressure.

In summary, the projectile according to the present invention may comprise separate compartments that, after launch, allow for (a) mixing of the chemi-luminescent materials, (b) heating of the materials in the projectile vessel, (c) pressurization of the projectile vessel, and (d) efficient expulsion of a day marker and heated chemi-luminescent mix from the vessel upon striking the target.

The invention thus provides for the efficient ejection of dry powder and heated chemi-luminescent liquid materials so that the location of the projectile's point of impact will be marked with a multi-spectral visual, infra-red and thermal signature.

The projectile allows for the marking of targets. The projectile does not create unexploded ordnance (UXO) and minimizes use of energetic materials such as reactive chemicals and/or pyrotechnics. There are environmental benefits to reducing UXO and reducing the use of reactive chemicals such as perchlorates which run off from watersheds and/or seep into ground water.

BRIEF DESCRIPTION OF THE DRAWINGS

FIG. 4 illustrates a commencement of launch of the projectile whereby launch acceleration and possibly centrifugal force break seals in the compartments allowing the components to mix in flight.

FIG. 6 shows the second stage of the projectile trajectory, with the projectile in ascendance.

FIG. 7 shows a third stage of the projectile trajectory, with the projectile commencing its descent.

FIG. 8 shows a fourth stage of the projectile trajectory, with the projectile rapidly descending.

FIG. 9 shows a fifth stage of the projectile trajectory, with the projectile about to impact with the ground at a high angle-of-attack.

DESCRIPTION OF THE PREFERRED EMBODIMENTS

Figure 1:
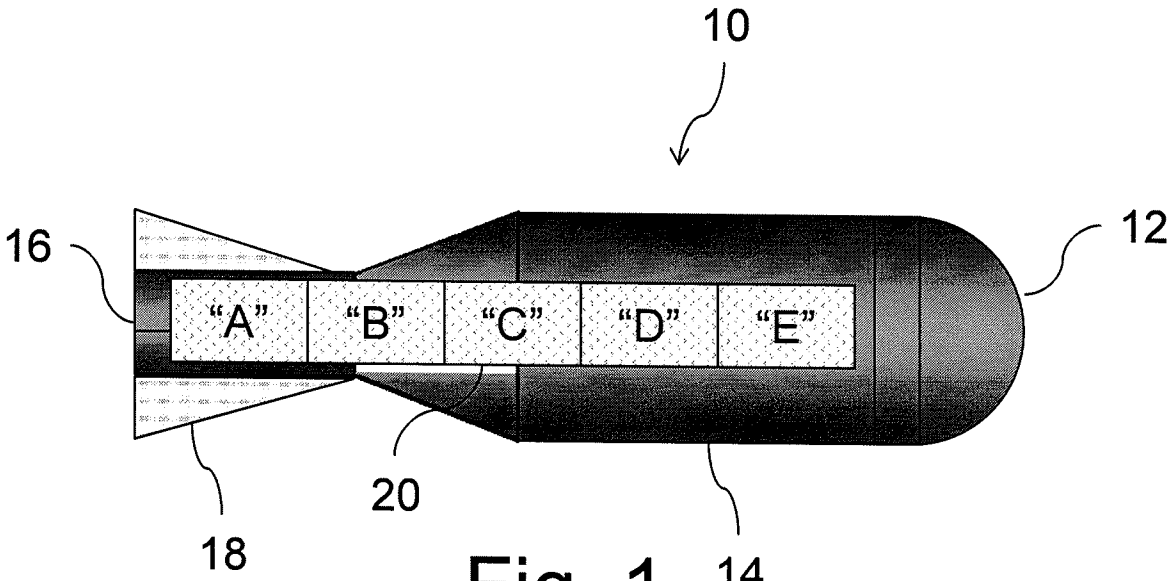
FIG. 1 is a representational diagram of a high angle-of-attack projectile comprising a built in, multi-spectral impact marking device.

The preferred embodiments of the present invention will now be described with reference to FIGS. 1-16 of the drawings. Identical elements in the various figures are designated with the same reference numerals.

FIG. 1 shows a projectile 10 having an ogive 12, a mortar body 14 and a vent 16 in a mortar tail 18. The projectile 10 is equipped with a tubular vessel 20 having five separate compartments, A, B, C, D and E, arranged in sequence with compartment A closest to the tail.

Figure 2:
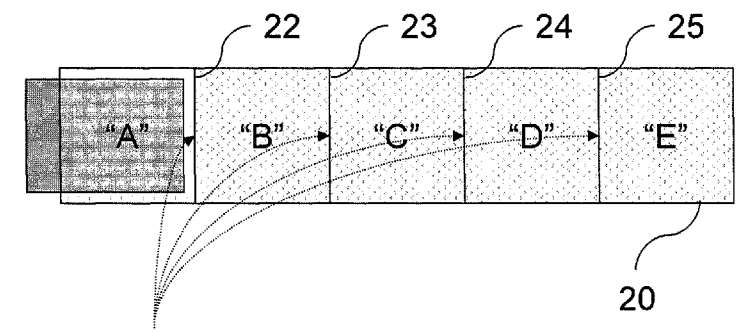
FIG. 2 is a representational diagram of a five-compartment impact marking device for high angle-of-attack projectiles.

As shown in FIG. 2, the compartments in the tubular vessel 20 are separated by membranes or seals 22, 23, 24 and 25, respectively. The seal 22, which separates compartments A and B, and the seal 24, which separates compartments C and D are designed to withstand the forces on setback (launch) of the projectile. Seals 23 and 25, on the other hand, are designed to break upon setback, allowing the components in compartments B and C, on one hand, and D and E, on the other, to mix on setback.

Thus, upon setback, the acceleration forces, and also possibly centrifugal forces, cause the components of compartments B-C and D-E to mix. When fitted to an airdrop bomb, use is made of wind and/or air pressure to activate devices which break seals 23 and 25, so that, in this case also, the components in compartments B-C and D-E mix.

The compartments A, B, C, D and E contain the following components:

A: A carrier containing red dye powder for daytime marking of the point of impact.

B and C: Two components of chemi-luminescent materials which, when mixed, glow brightly.

D and E: Two components which, when mixed, create a gas pressure, and/or two components which, when mixed, create heat.

The literature is replete with examples of chemi-luminescent materials. See, for example, U.S. Pat. No. 5,348,690.

Examples of chemical components which, when mixed, create heat (called exothermic reactions) include (1) powdered metals with water, for example the iron catalyzed reaction of magnesium powder with water, used to heat MREs (Meals Ready for Eating), (2) powdered metal oxides with water, for example calcium oxide (quicklime) with water, (3) powdered metals with aqueous metal salt solutions, for example zinc powder with copper sulfate solution, (4) hydration of anhydrous salts, for example water and anhydrous calcium chloride or copper sulfate, and (5) polymerization reactions, for example the catalyzed polymerization of monomethacrylate.

Examples of chemical components which, when mixed, create pressure (gas generating reactions) include (1) powdered metals with water or dilute acids, for example zinc powder and hydrochloric acid, (2) calcium carbide with water, (3) powdered metal carbonates or bicarbonates with dilute acids, for example calcium carbonate and citric acid.

To achieve quick mixing and rapid reaction of the chemicals, it is desirable to use liquid components or a mixture of liquid and powdered solid components.

It is best to avoid combustion reactions in the projectile, because of the risk of causing fires and to keep the projectile free from energetic materials, thus avoiding EOD issues.

Figure 3:
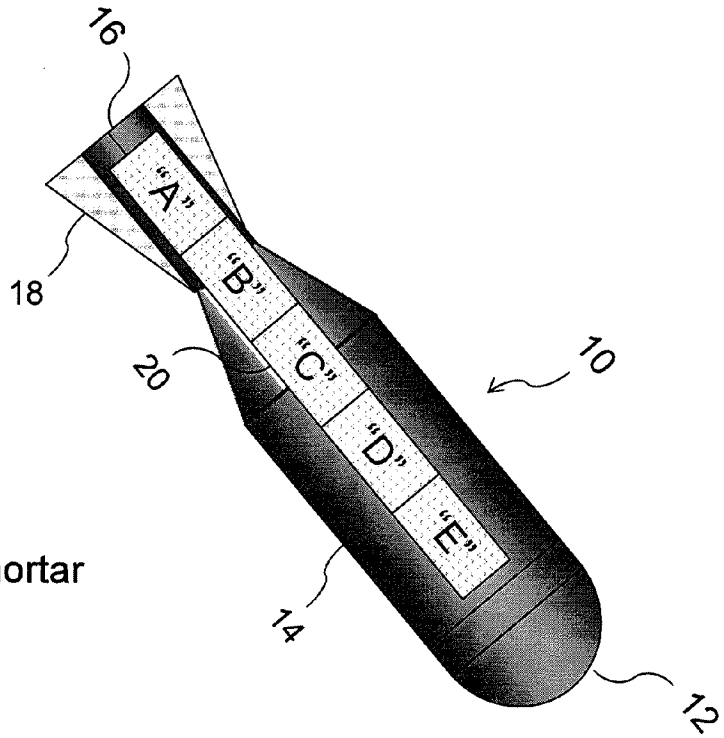
FIG. 3 depicts a high angle-of-attack projectile of the type shown in FIG. 1, comprising a mortar and ogive with a five-compartment tubular vessel fitted into the mortar body, a piston arranged in the ogive and a venting configuration on the mortar tail.

FIG. 3 is a detailed view of the projectile showing the five compartment tubular vessel 20 fitted into the mortar body 14, an ogive 12 including a piston, and a venting configuration 16 in the tail of the mortar.

Figure 4:
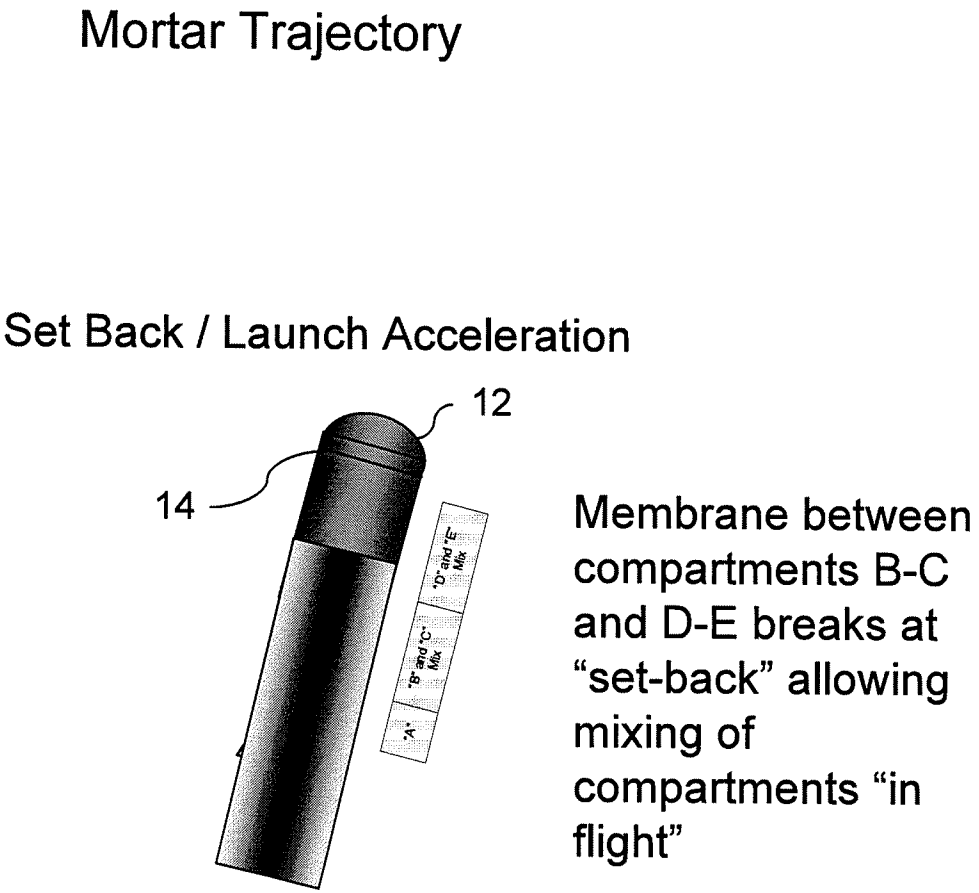
FIGS. 4 and 6-9 illustrate the projectile trajectory from set-back to flight and impact.

The projectile according to the present invention operates as follows:

On setback, as shown in FIG. 4, the membranes between compartments B-C and D-E break allowing their components to mix in flight.

Figure 5:
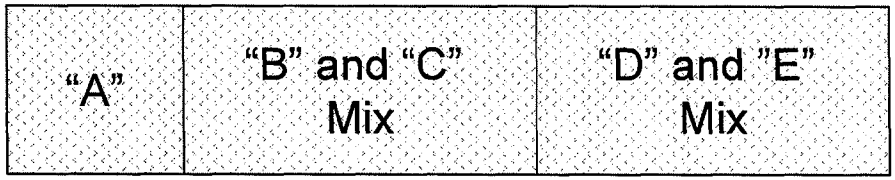
FIG. 5 illustrates the operation of the five-compartment design of the marking device.

As indicated in FIG. 5, when the components in compartments B and C mix, they form a chemi-luminescent mixture which begins to glow. When the components of compartments D and E mix, they react and produce either a gas under pressure and/or heat.

Figure 6:
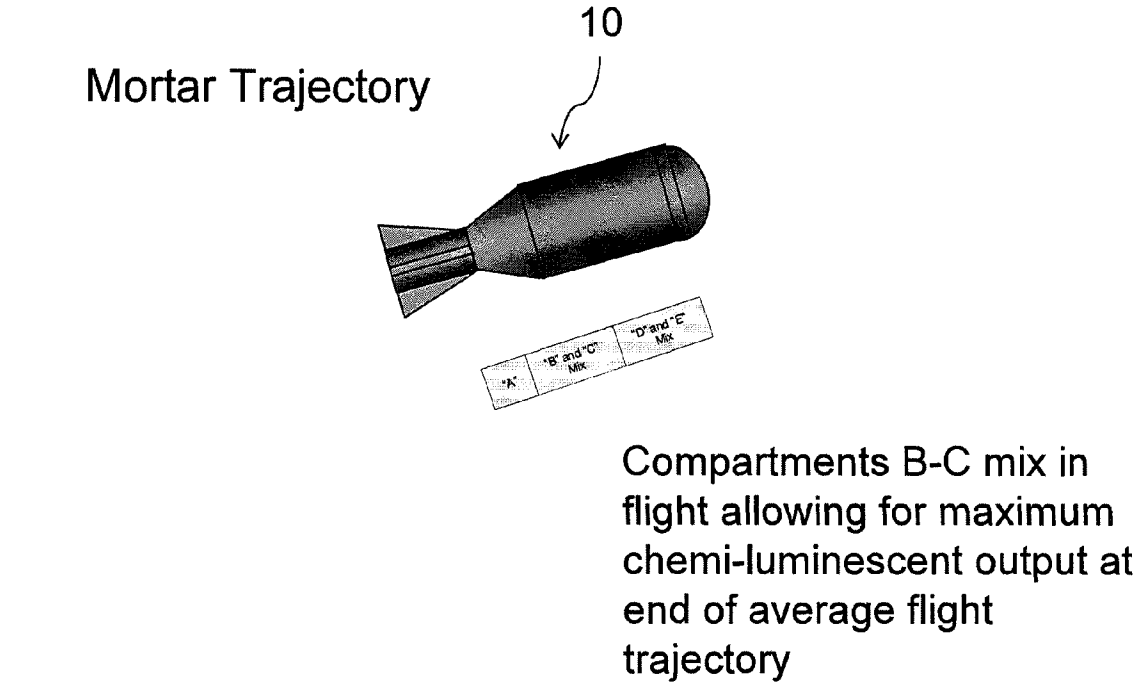

During flight, as depicted in FIG. 6, the chemi-luminescent mixture increases in brightness until it reaches its maximum luminescent output at the end of the projectiles trajectory.

Figure 7:
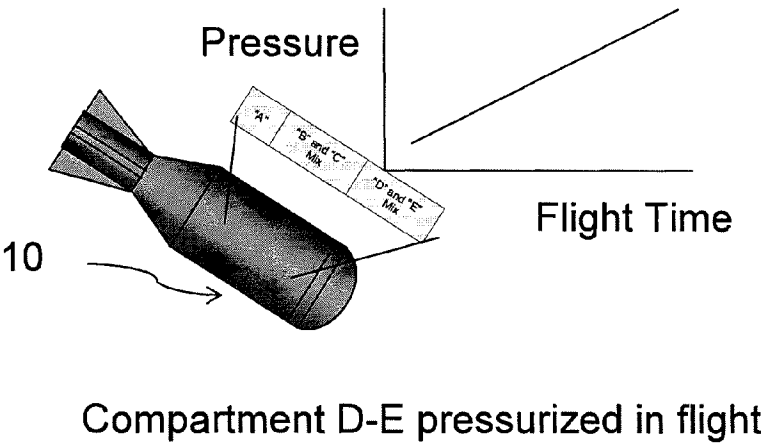
Figure 7:
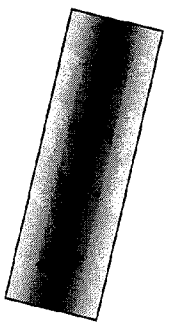
Figure 8:
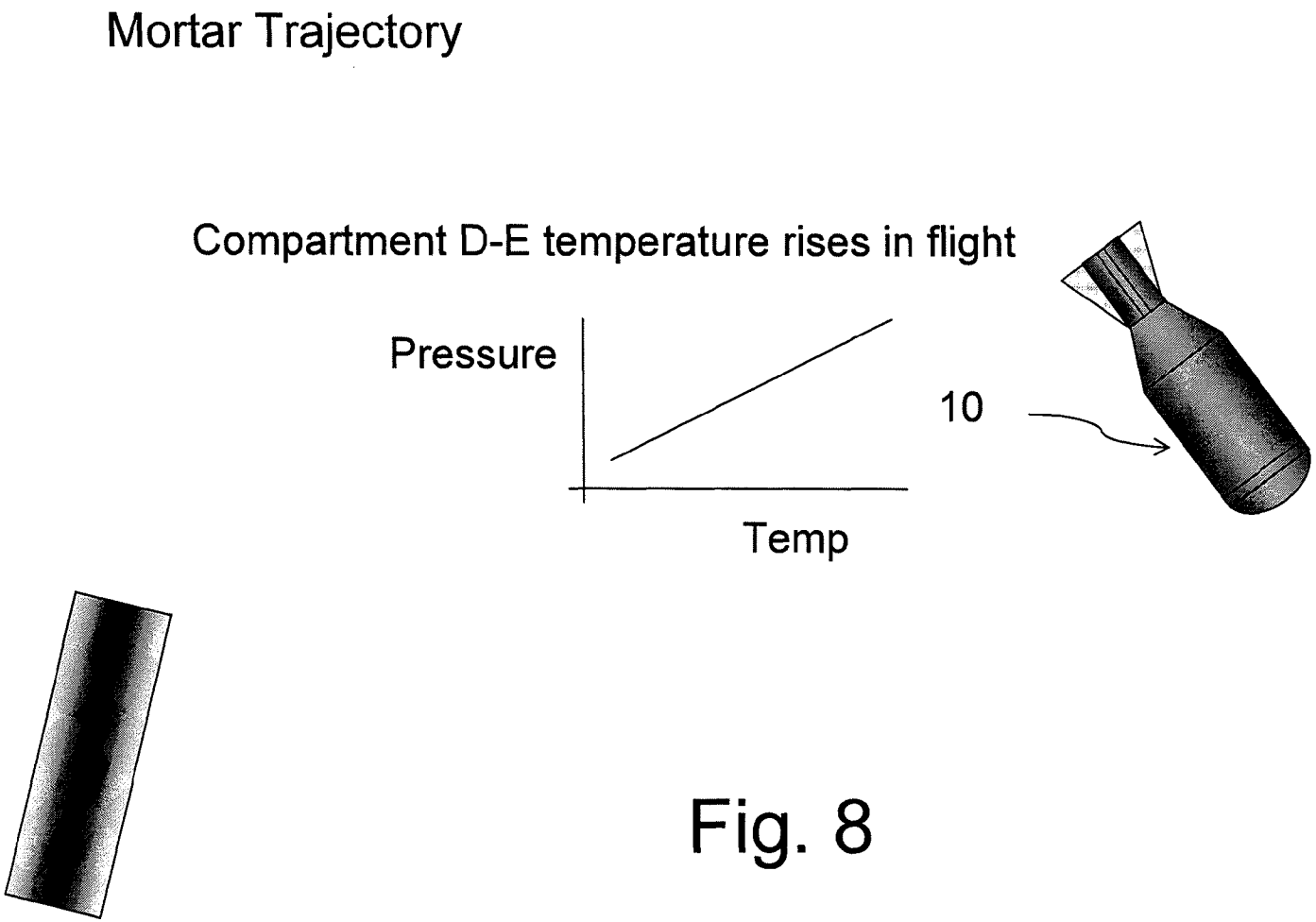

As indicated in FIG. 7, the reactants from the compartments D and E pressurize the tubular vessel 20 during flight. Alternatively or in addition, the temperature within the tubular vessel rises during the trajectory, warming the chemi-luminescent materials so that they glow, notwithstanding extreme low ambient temperatures. This is illustrated in FIG. 8.

Figure 9:
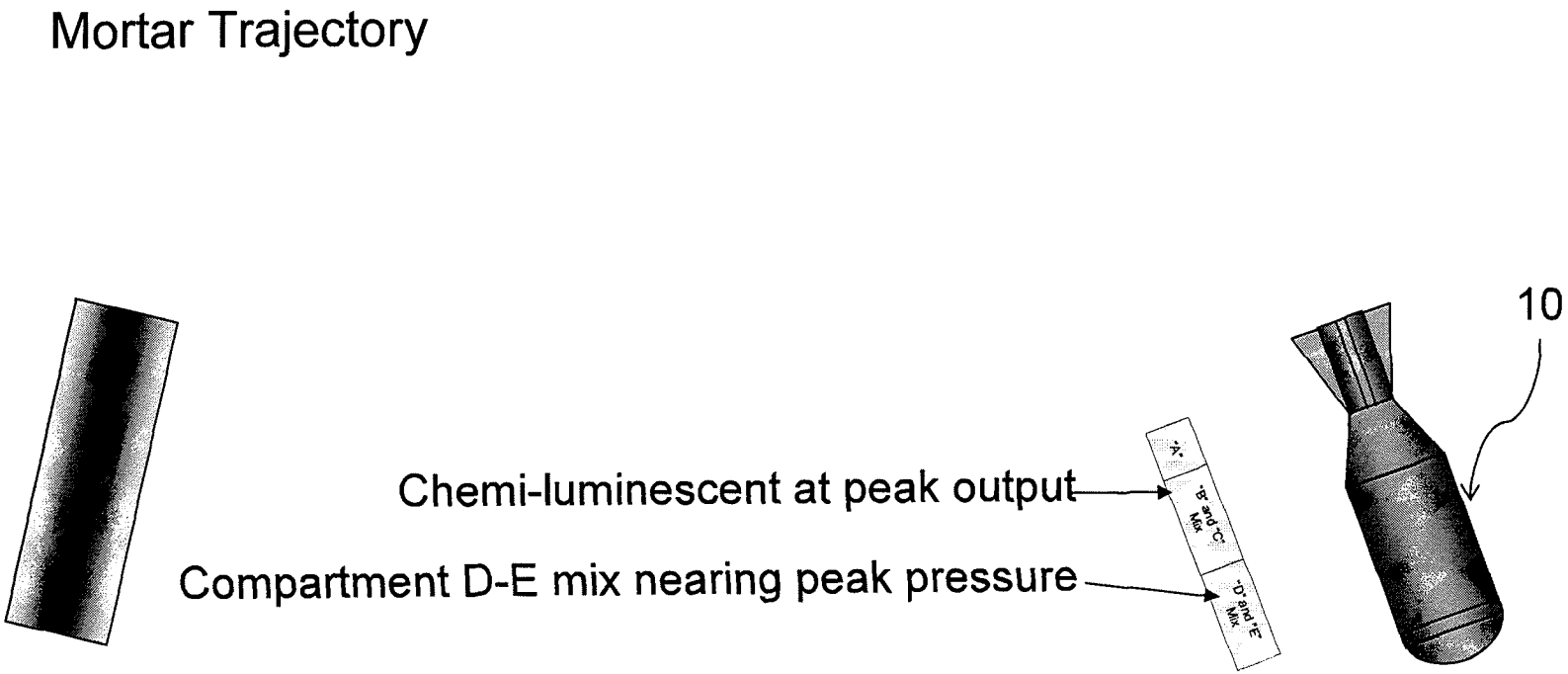
Figure 10:
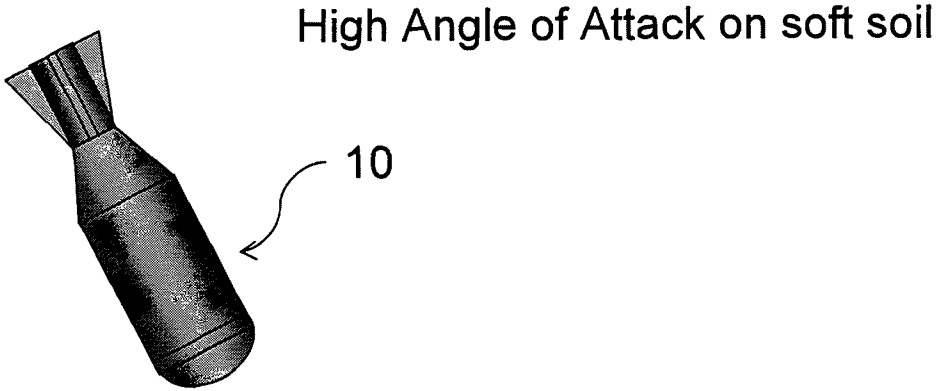
FIG. 10 illustrates a projectile about to impact on soft soil, resulting in deep penetration.
Figure 11:
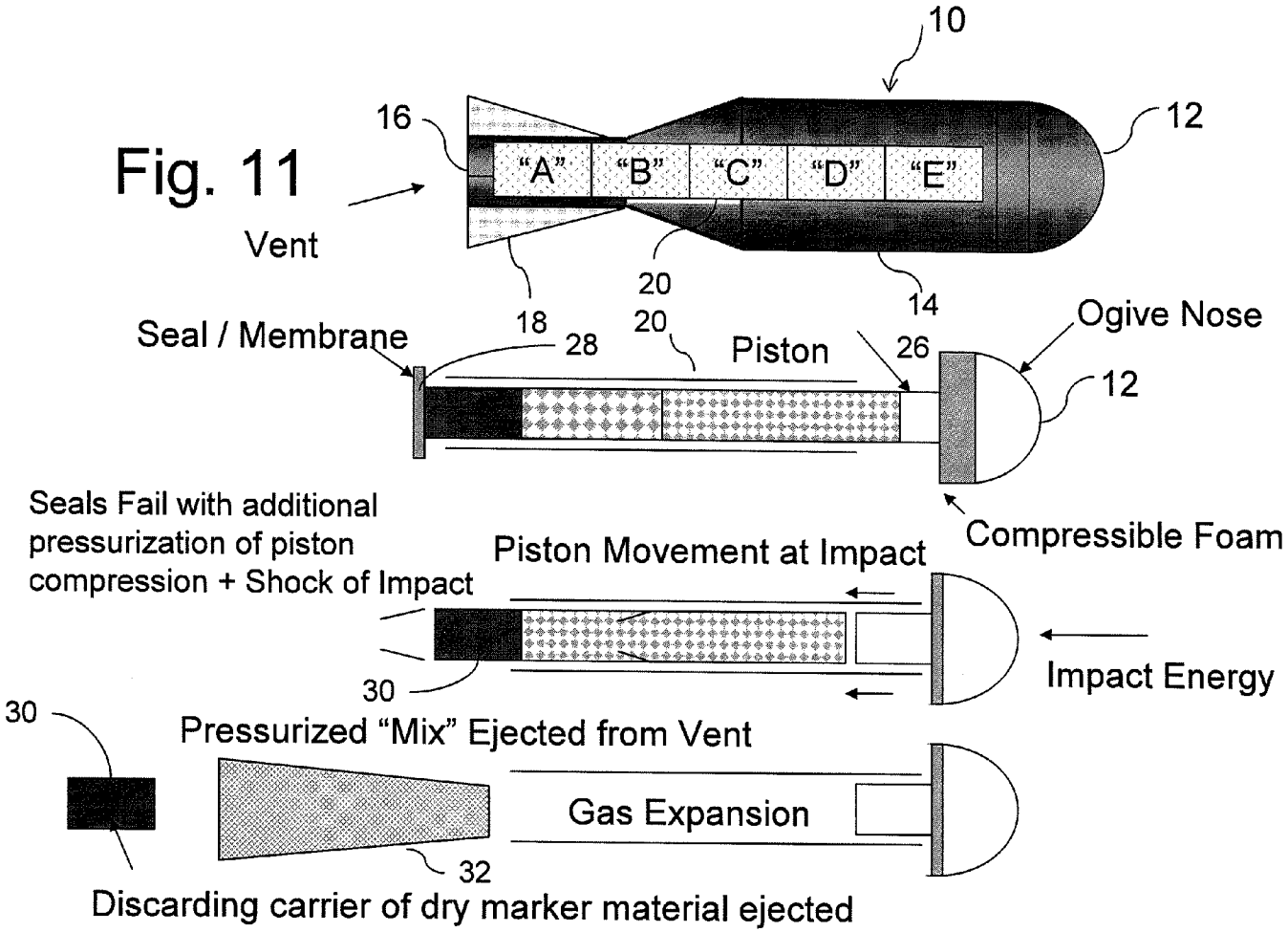
FIG. 11 illustrates details of the operation of the projectile upon impact with the ground.

In FIG. 9, immediately prior to impact, the chemi-luminescent materials reach their peak luminence and the reactants in compartments D and E near their peak pressure. If the projectile were to impact against a solid surface, the mortar body would burst and the dry powder mix and the chemi-luminescent liquid would be dispersed. However, especially in the case of a projectile which impacts with a high angle-of-attack, the projectile may land on soft soil and not burst open, with a result that marking of the point of impact would not ordinarily occur. The present invention provides a remedy for this situation since, during flight, a chemical reaction pressurizes the vessel 20 within the mortar body during flight, to cause the marking materials to disperse.

The projectile may also include a piston 26 connected to the ogive 12. Upon striking the ground, the piston depresses, further pressurizing the vessel and leading to a failure of a seal 28 that covers the vent 16 at the rear of the mortar body.

Without pressurization of the vessel or the provision of the piston, the device would not work in all cases where heavy projectiles (traveling at high velocity) may penetrate too deeply into the ground, thereby precluding effective expulsion of the marking material. See *Estimating Ordnance Penetration into Earth* by Crul, Taylor and Tipton, US Army Engineering and Support Center, Huntsville Ala. This paper describes the correlation of actual recovery data and hydracode runs to provide a understanding of the depth that various projectiles will penetrate the earth after impact.

Figure 12:
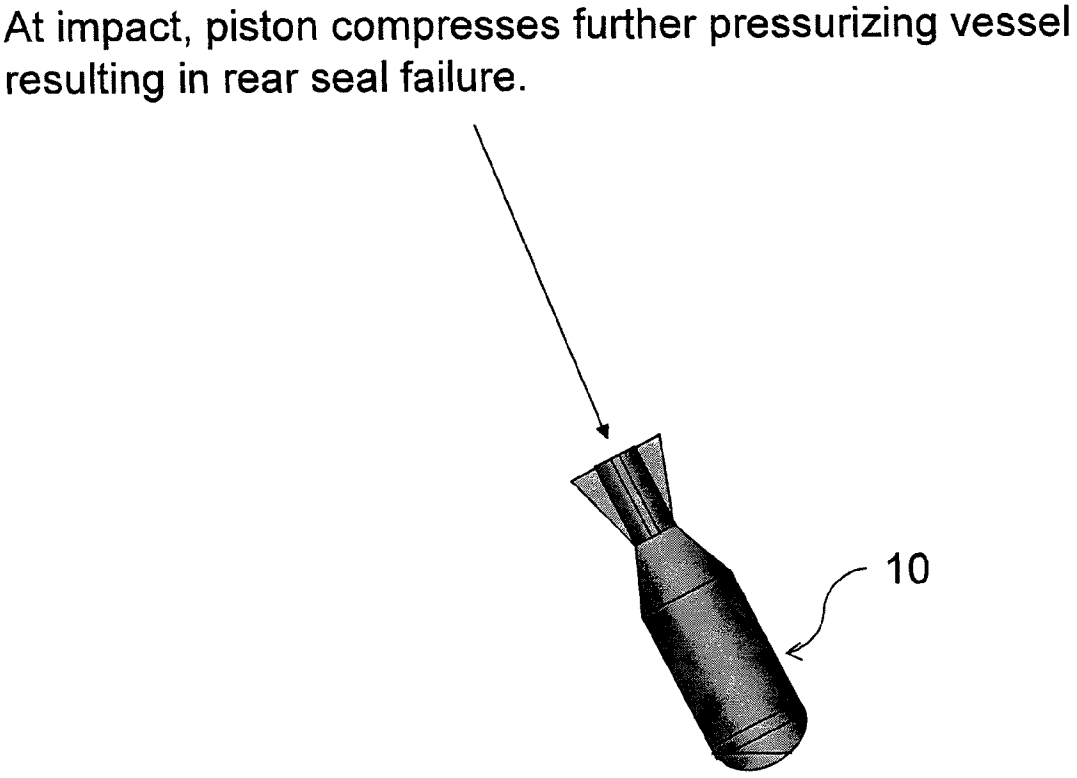
FIG. 12 shows the projectile impacting with the ground at the end of its trajectory.

FIG. 12 shows the projectile at the commencement of impact with the ground. When this occurs, the piston 26 compresses, further pressurizing the vessel and resulting in failure of the rear seal 28. After this rear seal fails, the pressure venting leads to the ejection of an expendable "carrier" or slug 30 filled with dry marker material, such as a red dye powder. After expulsion from the vessel, the carrier releases the dry powder plume.

Also, due to the pressure in the vessel 20, a column of mixed chemi-luminescent liquid 32 is ejected through the vent. The expulsion of the chemi-luminescent material may utilize laminar flow technology to maximize the height (head) of the ejected material.

Figure 13:
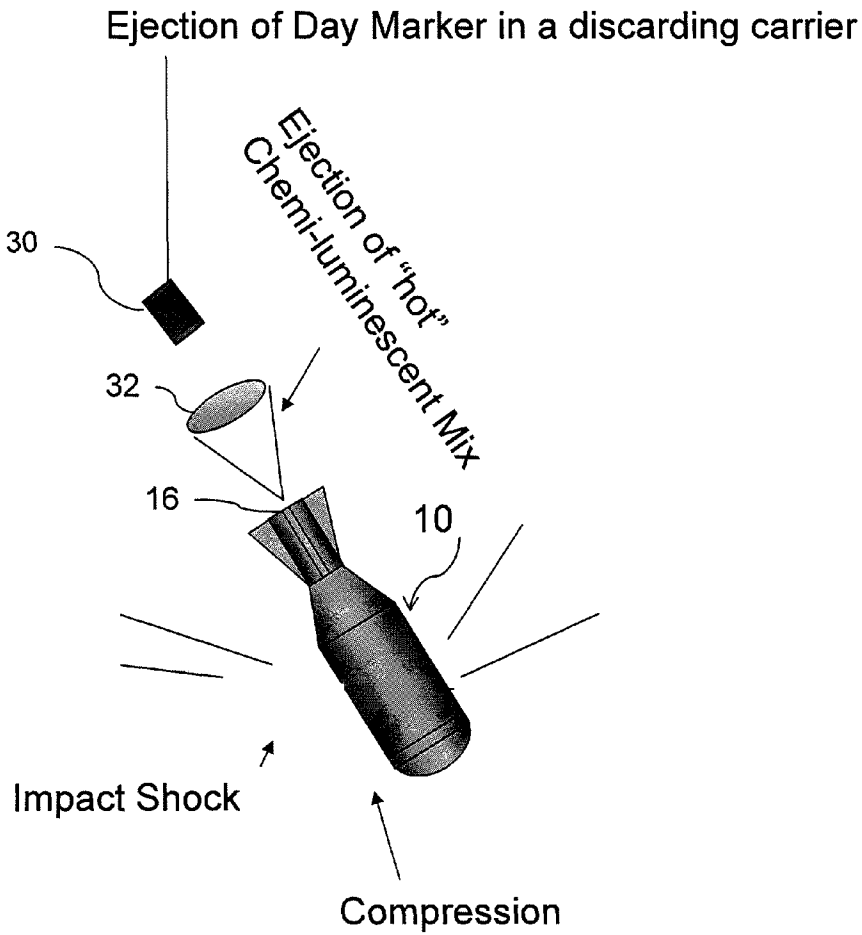
FIG. 13 shows the ejection of a day marker dry powder carrier and the nighttime chemi-luminescent marker from the tail of the projectile.
Figure 14:
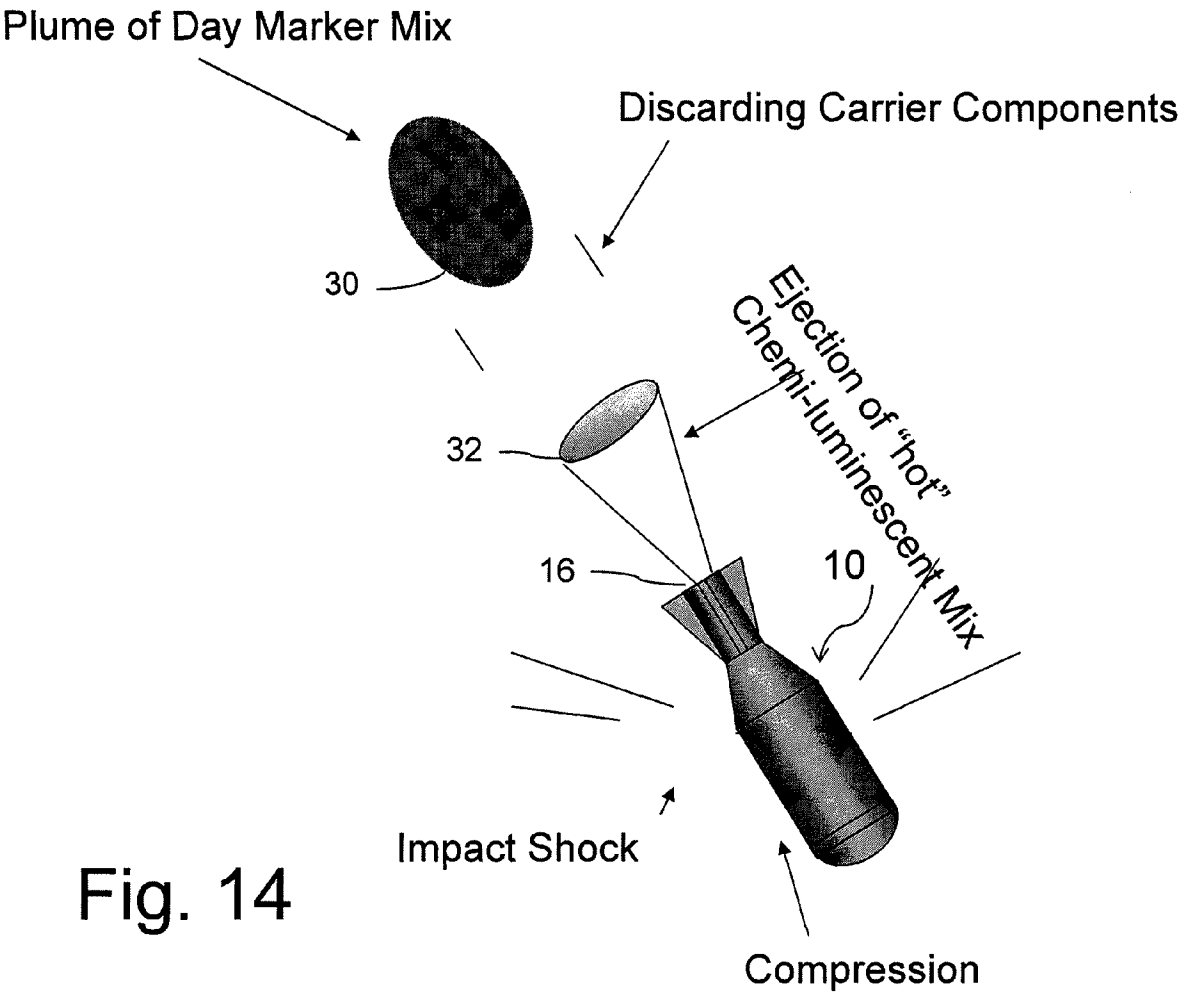
FIG. 14 shows the projectile immediately after impact with a plume of the day marker powder.
Figure 15:
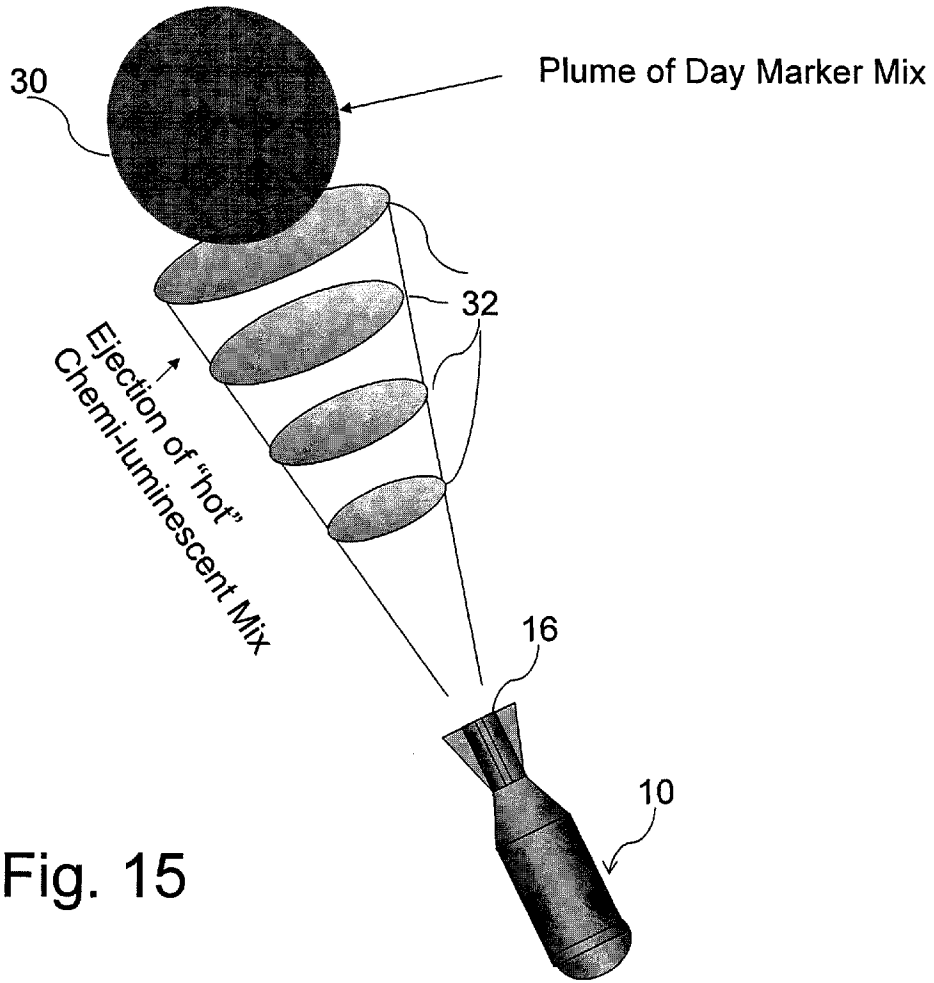
FIG. 15 shows both the day and night markers that have been ejected from the projectile which, at this time, is buried in the ground.
Figure 16:
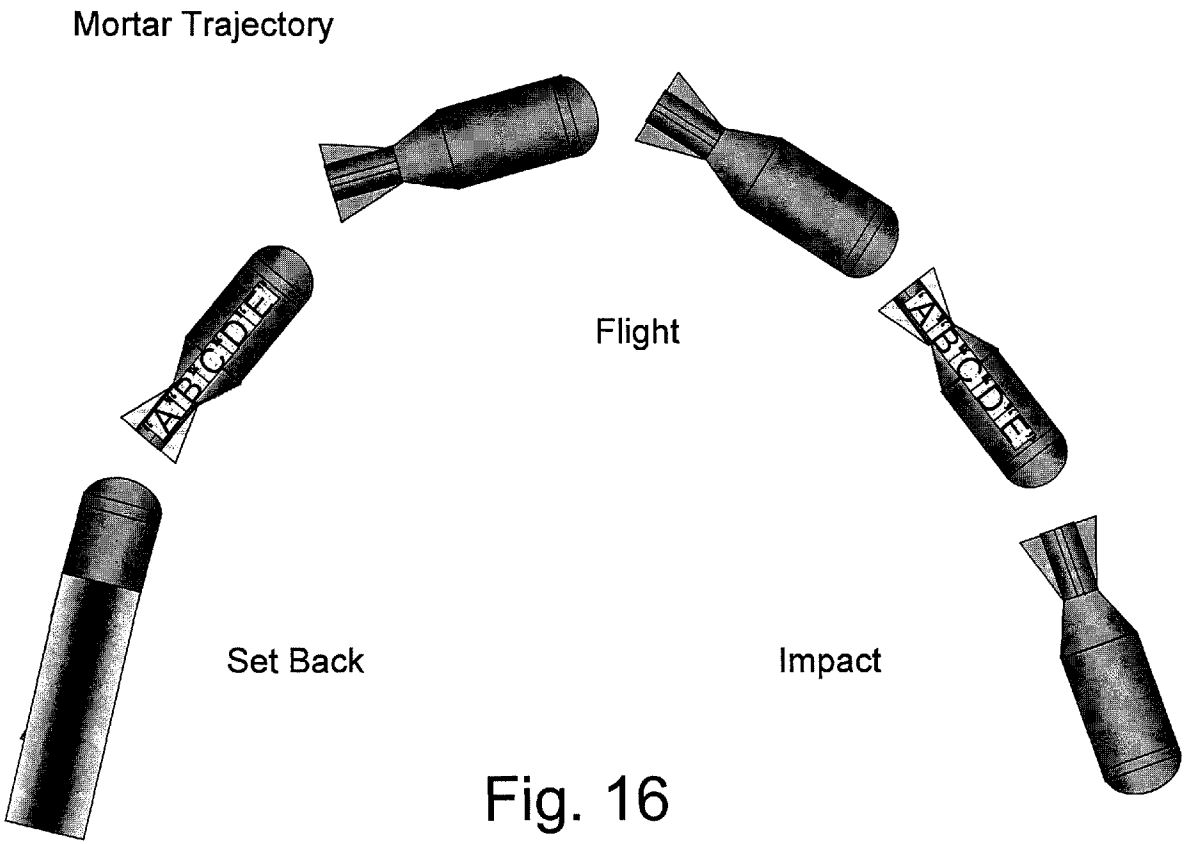
FIG. 16 is a diagram showing the phases in the projectile trajectory.

FIGS. 13-15 depict the sequence of projectile function upon compression of the piston. The dry marker carrier 30 is followed by the chemi-luminescent mix 32.

With a heavy projectile traveling at high velocity, it may be necessary to eject marking material using well known pyrotechnic devices. Such devices will still utilize a stacked configuration ejecting (with one charge) both the dry marker 30 and the chemi-luminescent materials 32.

FIGS. 14 and 15 show how the dry marker powder material 30, which expands to form a plume, and the chemi-luminescent liquid material are ejected from the vent 16 and expand to mark the point of impact, both by day (plume 30) and night (glowing liquid 32).

In conclusion, the marking device of the present invention provides for efficient ejection of dry mix and heated chemi-luminescent liquid so that the location of impact is marked with a multi-spectral visual, infra-red and thermal signature. The marking device is initiated at setback and is operative during the flight of the projectile to cause both day and night marker materials to be ejected from the projectile upon impact. The marking device according to the invention is intended to operate at any ambient temperature and with any type of impact, be it hard or soft, to mark the point of impact.

While embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the claims.

What is claimed is:

1. A high angle of attack projectile designed to mark its impact with a target, said projectile comprising, in combination:

(a) a projectile body designed to withstand the forces applied when the projectile is launched and having (1) a projectile head with an ogive designed to impact the target and (2) a projectile tail designed to steady the projectile in flight, said projectile body having a central longitudinal axis between said head and said tail and a rear seal which, when broken, permits ejection of at least one marking agent through said tail;

(b) a plurality of compartments disposed within said projectile body and arranged successively along said longitudinal axis between said projectile head and said projectile tail, said compartments being separated by compartment walls, at least one of which is designed to be broken when the projectile is launched;

(c) said at least one marking agent disposed in at least one of compartments for marking the position of the target when the projectile strikes the target, said marking agent. comprising at least one of:

(1) a plurality of first chemical components each received in a separate one of said compartments, said first components being mixed and reacting chemically with each other during flight of the projectile, causing the mixed first components to luminesce and mark the target when the projectile strikes the target, the wall between the compartments holding said first components being designed to be broken when the projectile is launched, while retaining the first chemical components within the projectile body, whereby the first components are mixed at the time the projectile is launched and luminesce by the time the projectile strikes the target;

(2) a plurality of second chemical components each received in a separate one of said compartments, said second components being mixed and reacting chemically with each other during the flight of the projectile, causing the second components to create heat, the all between the compartments holding said second components being designed to be broken when the projectile is launched, while retaining the second chemical components within the projectile body, wherein the second components are mixed at the time the projectile is launched and create heat by the time the projectile strikes the target; or (3) a low density, fine, dry powder material disposed in a separate one of the compartments and designed to create a plume to marking the target when the projectile strikes the target; and (d) a plurality of third chemical components each received in a separate one of said compartments, said third components being mixed and reacting chemically with each other during the flight of the projectile, causing the third components to create a gas pressure, the wall between the compartments holding said third components being designed to be broken when the projectile is launched, while retaining the third chemical components events within the projectile body, wherein the third components are mixed at the time the projectile launched and create sufficient pressure, by the time the projectile strikes the target, to break said rear seal and eject said at least one marking agent from the tail of the projectile;

whereby said at lest one marking agent is blown upward into the air from the tail after impact.

2. The projectile defined in claim 1, further comprising a piston disposed in the projectile head and arranged to press against said compartments, by a force applied by said ogive when said projectile strikes the target, said piston forcing said compartments to discharge said at least one marking agent out an opening in the projectile tail.

3. The projectile defined in claim 1, wherein the walls between compartments is holding said chemicals are broken due to at least one of initial acceleration forces and centrifugal forces when said projectile is fired from a weapon.

4. The projectile defined in claim 1,wherein said marking agent comprises said plurality of first chemical components.

5. The projectile defined in claim 1, wherein said marking agent comprises said plurality of second chemical components.

6. The projectile defined in claim 1, wherein said marking agent comprises both said plurality of first chemical components and said plurality of second chemical components.

7. The projectile defined in claim 1, wherein said marking agent comprises said dry powder material.

8. The projectile defined in claim 7, wherein slid marking agent further comprises said plurality of first chemical components.

9. The projectile defined in claim 7, wherein said marking agent further comprises plurality of second chemical components.

10. The projectile defined in claim 7, wherein said marking agent further comprises both said plurality of first chemical components and said plurality of second chemical components.

* * * * *